US005690412A

United States Patent [19]

Sheldon

[11] Patent Number: 5,690,412

[45] Date of Patent: Nov. 25, 1997

[54] SOLAR ILLUMINATED JEWELRY

[75] Inventor: Joseph M. Sheldon, Sedona, Ariz.

[73] Assignee: Said M. Sekandari, Sedona, Ariz.; a part interest

[21] Appl. No.: 673,537

[22] Filed: Jul. 1, 1996

[51] Int. Cl.[6] ..... F21L 15/08

[52] U.S. Cl. ..... 362/104; 362/183; 362/806

[58] Field of Search ..... 63/321; 362/104, 362/103, 183, 307, 806

[56] References Cited

U.S. PATENT DOCUMENTS

| | | | |
|---|---|---|---|
| 2,854,563 | 9/1958 | Catching | 240/6.4 |
| 3,384,740 | 5/1968 | Wood | 240/6.4 W |
| 3,805,047 | 4/1974 | Dockstader | 240/6.4 W |
| 3,968,357 | 7/1976 | Hamilton | 240/6.4 W |
| 4,101,955 | 7/1978 | DuNah | 362/104 |
| 4,262,324 | 4/1981 | Murphy | 362/104 |
| 4,296,459 | 10/1981 | DeLuca | 362/104 |
| 4,508,520 | 4/1985 | Sellers et al. | 446/485 |
| 4,556,932 | 12/1985 | Lehrer et al. | 362/103 |
| 5,140,840 | 8/1992 | Miceli | 63/12 |
| 5,519,591 | 5/1996 | McCrary | 362/104 |

*Primary Examiner*—Stephen F. Husar
*Attorney, Agent, or Firm*—Warren F. B. Lindsley

[57] ABSTRACT

An ornamental article utilizing a miniature battery as a source of electrical power for illuminating a gem stone in an article of wear which battery is selectively charged by solar energy.

4 Claims, 1 Drawing Sheet

SOLAR ILLUMINATED JEWELRY

BACKGROUND OF THE INVENTION

This invention relates to illuminated displays and more particularly to ornamental or costume jewelry, or the like having gem settings mounted in brooches, belt buckles, bracelets and coiffure ornaments that are illuminated by a self-contained battery source which is periodically charged by solar energy.

A relatively small lighted ornamental article is desirable which contains lens, lamp and an electrical energy source which source is periodically charged by solar energy.

DESCRIPTION OF THE PRIOR ART

The following patents comprise the prior art known at this time.

U.S. Pat. No. 4,101,955 discloses an ornamental article with an illuminated display.

U.S. Pat. No. 4,556,932 discloses a battery-powered, self-contained lighted novelty item.

U.S. Pat. No. 5,140,840 discloses an electric earring having an enhanced display element such as a translucent stone.

U.S. Pat. No. 3,805,047 discloses a flashing jewel pendant having a front section made of translucent plastic material and a back section made of any suitable opaque material. A switch controls a lamp.

U.S. Pat. No. 2,854,563 illustrates illuminated jewelry in which a receptacle of any non-conducting material is attached to the rear of a panel. A switch in the receptacle causes lamps 19 to illuminate.

Other patents of interest comprise the following U.S. patents which, although of interest, are not believed to anticipate the claimed invention.

| | |
|---|---|
| 4,508,520 | 3,968,357 |
| 4,296,459 | 3,384,740 |
| 4,262,324 | |

SUMMARY OF THE INVENTION

This invention relates to ornamental articles having an illuminated displays and, more particularly, to such an article containing a battery source and self-contained means for recharging the battery source with solar energy.

It is, therefore, one object of this invention to provide a new and improved self-contained illuminated display wherein solar energy is utilized to illuminate the display.

Another object of this invention is to provide a new and improved ornamental article wherein a self-contained lighting means selectively illuminates a gem stone and which lighting means is selectively charged by solar energy.

A further object of this invention is to provide an ornamental article containing a battery operated illuminating means that is solar energized.

A still further object of this invention is to provide a new and improved ornamental article containing a gem stone which is illuminated by an on/off electrical source switch worn by the user.

Additional objects and features of this invention will appear from the following description in which the preferred embodiment has been set forth in detail in conjunction with the accompanying drawing.

DESCRIPTION OF THE PREFERRED EMBODIMENT

Figure 1:
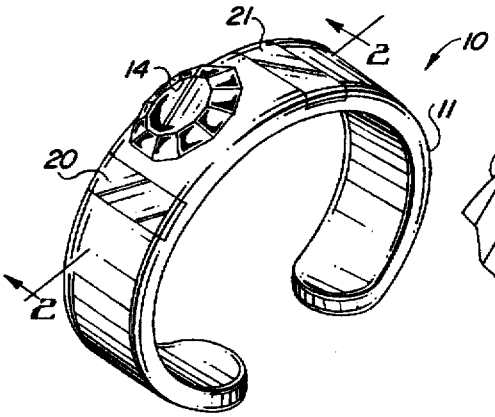
FIG. 1 is an isometric view of an illuminable ornamental article of wear together with solar cells for energizing a self-contained battery means and embodying the invention.
Figure 2:
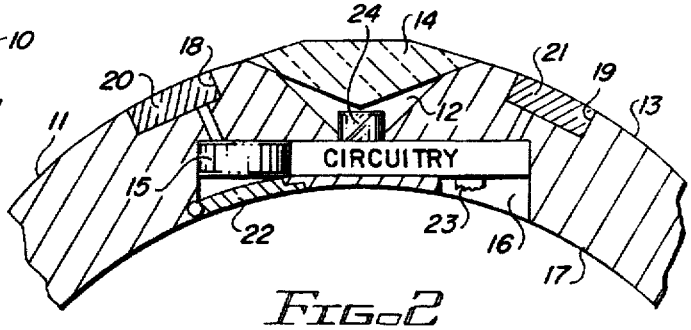
FIG. 2 is a cross sectional view of FIG. 1 taken along the line 2—2.

Referring more particularly to the drawing by characters of reference, FIGS. 1 and 2 disclose a bracelet 10 comprising a flexible circular arm band 11 for partially surrounding an arm of a wearer. The arm band 11 contains an opening 12 in its outer periphery 13 for mounting a gem stone 14 or other type of transparent object which is illuminated at will by a battery means 15 formed in an opening 16 in the inner periphery 17 of the arm band.

A pair of openings 18 and 19 are provided in the outer periphery 13 of the arm band one on each side of opening 12 for each receiving one or more solar cells 20, 21.

The battery means 15 such as a 1½ volt battery is held in place by a hinged biased access panel 22. Further, a three position switch 23 having charge, off and on positions is provided in opening 16 with an LED or bulb 24 mounted to extend into opening 12 between the gem stone 14 and the battery means 15.

Figure 6:
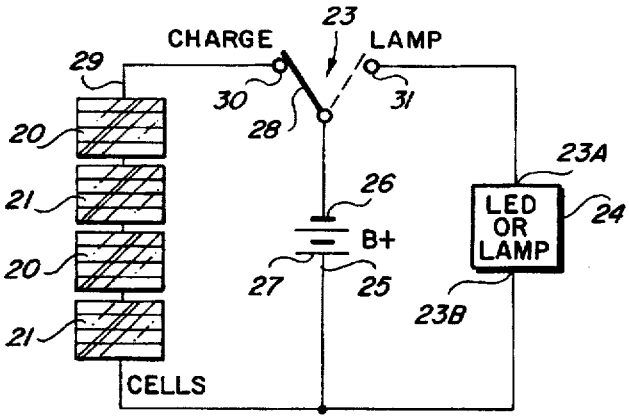
FIG. 6 is an electrical schematic of one embodiment of the present invention.

As shown in FIG. 6, the battery means comprises a plurality of series connected solar cells 20, 21 connected at one end to the negative terminal 25 of battery 27. The positive terminal 26 of battery 27 is connected through a movable arm 28 of switch 23 to the other terminal 29 of the series connected solar cells 20, 21.

Thus, when the solar cells are operatively charging battery 27, the switch 23, is positioned as shown in full lines in FIG. 6.

When it is desired to illuminate the gem stone 14 of bracelet 10, arm 28 of switch 23 is moved to its other position shown in dash lines thereby causing current to flow from positive terminal 26 of battery 27 through the arm of switch 23 to terminal 23A of bulb 24, the negative terminal 25 of battery 27 is connected to the other terminal 23B of bulb 24.

When arm 28 of switch 23 is in a position half way between its terminals, 30 and 31, the system is off, neither charging the battery nor illuminating the gem stone.

Figure 3:
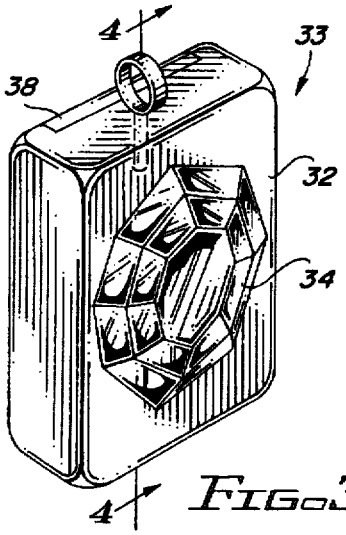
FIG. 3 is an isometric view of a further embodiment of the invention illustrating a solar energizable pendant.
Figure 4:
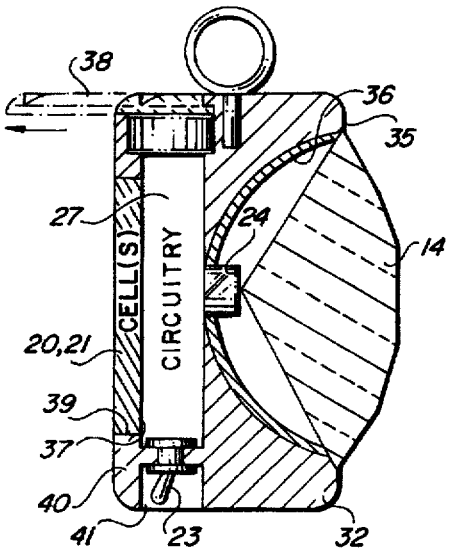
FIG. 4 is a cross sectional view of FIG. 3 taken along the line 4—4.
Figure 5:
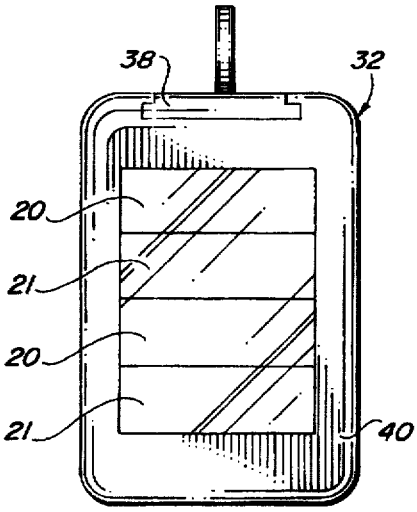
FIG. 5 is a back view of FIG. 3 illustrating the solar cell arrangement.

FIGS. 3, 4 and 5 disclose the invention as mounted in a housing 32 forming a part of a brooch or pendant 33. The brooch or pendant contains the circuitry as shown and described for the battery means of FIG. 1 with a gem stone 34 being illuminated by bulb 24 mounted in a reflector 35 in an opening 36 in housing 32.

The battery 27 is mounted in a hollow opening 37 in the back of housing 32 with a slide arm 38 providing access thereto. Solar cells 20, 21 are inserted in opening 39 in the back panel 40 of housing 32 with switch 23 as shown in FIG. 4 being mounted in an opening 41 in the bottom of housing 32.

Although but two embodiments of the invention have been illustrated and described, it will be apparent to those skilled in the art that various changes and modifications may be made therein without departing from the spirit of the invention or from the scope of the appended claims.

What is claimed is:

1. An ornamental article utilizing a miniature battery as a source of electrical power for illumination of a gem stone mounted therein comprising:

a casing providing a first opening in one side thereof, a gem stone mounted in said first opening, said casing defining a second opening in another side thereof for receiving a battery means, said battery means comprising an electric bulb energized by said battery means for illuminating said gem stone by passing light therethrough, solar means comprising at least one solar cell mounted in the outer periphery of said casing for receiving solar rays from the sun, and switch means mounted in said second opening for selectively connecting said solar cell to said battery means for charging thereof and to said bulb for illumination thereof.

2. The ornamental article set forth in claim 1 wherein:

said casing comprises a ring shaped bracelet.

3. The ornamental article set forth in claim 1 wherein:

said casing comprises a brooch.

4. The ornamental article set forth in claim 1 wherein:

said solar means comprises one or more solar cells mounted in the outer periphery of said casing on each side of said gem stone.

* * * * *